US007748249B2

(12) United States Patent
Shiroza

(10) Patent No.: US 7,748,249 B2
(45) Date of Patent: Jul. 6, 2010

(54) WORKPIECE CONVEYANCE DEVICE FOR PRESSING MACHINE

(75) Inventor: Kazuhiko Shiroza, Komatsu (JP)

(73) Assignee: Komatsu Ltd., Tokyo (JP)

( * ) Notice: Subject to any disclaimer, the term of this patent is extended or adjusted under 35 U.S.C. 154(b) by 808 days.

(21) Appl. No.: 11/631,870

(22) PCT Filed: Jul. 8, 2005

(86) PCT No.: PCT/JP2005/012687

§ 371 (c)(1),
(2), (4) Date: Jan. 8, 2007

(87) PCT Pub. No.: WO2006/006538

PCT Pub. Date: Jan. 19, 2006

(65) Prior Publication Data

US 2007/0289352 A1 Dec. 20, 2007

(30) Foreign Application Priority Data

Jul. 9, 2004 (JP) ..... 2004-203104

(51) Int. Cl.
*B65G 25/00* (2006.01)
*B21D 43/05* (2006.01)
*H02K 41/02* (2006.01)

(52) U.S. Cl. ..... 72/422; 72/420; 72/405.1; 72/405.13; 72/346; 72/361

(58) Field of Classification Search ..... 72/346, 72/361, 405.13, 405.15, 405.16, 420, 421, 72/422
See application file for complete search history.

(56) References Cited

U.S. PATENT DOCUMENTS 4,133,199 A * 1/1979 Shirao ..... 72/405.16

(Continued)

FOREIGN PATENT DOCUMENTS

DE 195 06 079 8/1996

(Continued)

OTHER PUBLICATIONS

Chinese First Office Action, issued Nov. 30, 2007.

(Continued)

*Primary Examiner*—David B Jones
(74) *Attorney, Agent, or Firm*—Wenderoth, Lind & Ponack L.L.P.

(57) ABSTRACT

A work conveyance device for a pressing machine, consuming less energy and enabling reduction in production costs. The workpiece conveyance device has a pair of transfer bars provided in parallel to a feed direction, support members for moving each of the transfer bars freely in the feed direction while restricting the transfer bars in a lift direction, linear motors interposed between the support members and the transfer bars for moving the transfer bars in the feed direction relative to the support members, lift devices for moving the support members in the lift direction, and workpiece holding jigs detachably mounted to the transfer bars for holding a workpiece.

10 Claims, 7 Drawing Sheets

U.S. PATENT DOCUMENTS

| | | | | | |
|---|---|---|---|---|---|
| 4,511,029 | A | * | 4/1985 | Okawa | 72/405.13 |
| 5,248,288 | A | | 9/1993 | Kamiya et al. | |
| 5,566,814 | A | * | 10/1996 | Hofele | 72/405.16 |
| 5,586,464 | A | * | 12/1996 | Horde et al. | 72/405.16 |
| 5,690,026 | A | * | 11/1997 | Thudium et al. | 198/621.1 |
| 5,802,967 | A | * | 9/1998 | Thudium et al. | 72/405.13 |
| 6,105,754 | A | | 8/2000 | Farina et al. | |
| 6,931,905 | B2 | * | 8/2005 | Rubalcava et al. | 72/405.13 |

FOREIGN PATENT DOCUMENTS

| | | |
|---|---|---|
| JP | 7-41535 | 9/1995 |
| JP | 8-243661 | 9/1996 |
| JP | 10-156455 | 6/1998 |
| JP | 10-314871 | 12/1998 |
| JP | 2003-290851 | 10/2003 |

OTHER PUBLICATIONS

German Office Action (in English language) issued Nov. 20, 2007.

* cited by examiner

OVERALL BLOCK DIAGRAM OF PRESS

BLOCK DIAGRAM OF WORKPIECE CONVEYANCE DEVICE

EXPLANATORY DIAGRAM OF MOTION OF TRANSFER BAR

OVERALL BLOCK DIAGRAM OF A PRESS IN WHICH A CONVENTIONAL 3-DIMENSIONAL TRANSFER FEEDER IS EMPLOYED

WORKPIECE CONVEYANCE DEVICE FOR PRESSING MACHINE

TECHNICAL FIELD

The present invention relates to a workpiece conveyance device for conveying a workpiece within a press machine.

BACKGROUND ART

In conventional transfer presses, in which a plurality of processing steps are provided in a press main body, a transfer feeder for conveying a workpiece in sequence to a subsequent step is provided between each processing step. A commonly known transfer feeder is a 3-dimensional transfer feeder in which a workpiece is held by workpiece holding jigs, the workpiece being conveyed in sequence to a subsequent step by 3-dimensional direction movement of the workpiece holding jigs in the feed direction (workpiece conveyance direction), clamp direction (horizontal orthogonal direction to the feed direction), and the lift direction.

FIG. 7 shows the overall configuration of a transfer press in which a conventional 3-dimensional transfer feeder is employed.

A transfer feeder 110 has a left/right pair of transfer bars 113 parallel to the feed direction, a plurality of workpiece holding jigs not shown in the diagram for holding a workpiece being detachably mounted in these transfer bars 113. A workpiece 106 is moved in sequence to a downstream-side mold 130 by the 3-dimensional movement operation for the reciprocating feed/return movement in the feed direction (forward-backward movement), the reciprocating lift/down movement (rise-fall movement) in the lift direction (up-down direction) and the reciprocating clamp/unclamp movement (left-right movement) in the clamp direction (direction orthogonal in the horizontal plane to the feed direction) of these transfer bars 113. The fundamental operating pattern of the transfer bars 113 is as follows: clamp, lift, feed, down, unclamp and return. In addition, as devices for facilitating the operation of the transfer bars 113 as described above, a feed device (not shown in the diagram) that provides for movement in the feed direction and a lift/clamp device 140 that provides for movement in the lift direction and clamp direction are provided in the transfer feeder 110.

A feed box 111 in which the feed device is installed is protrudingly provided in either the upstream or downstream side face of a press main body 101 and, in addition, a lift clamp box in which the lift/clamp device 140 is installed is provided between left and right uprights 103 at both the front and rear on a bed 102.

In addition, the patent literature 1 discloses a technology configured from a feed carrier to which a feed bar is connected to allow free movement in the up-down and left-right directions but restrict movement in the forward-backward direction (feed direction), a feed unit for moving the feed carrier forward and backward, and a linear motor serving as a drive source for the feed unit.

Patent literature 1: Japanese Patent Application Laid-Open No. H10-314871

DISCLOSURE OF THE INVENTION

Problems to be Solved by the Invention

In workpiece conveyance devices as shown in FIG. 7 and disclosed by the patent literature 1, the movement of the transfer bars in the lift direction and clamp direction is avoided by a lift/clamp device and, in addition, the feed carrier for supporting the transfer bars is large and heavy. Accordingly, a high output servomotor or linear motor must be provided as a drive source for driving the feed carrier in the feed direction, and this is undesirable from the aspects of both energy reduction and manufacturing costs.

In addition, because servomotors with a rotating output shaft necessitate the use of a power converting mechanism such as a rack and pinion mechanism to convert rotational motion to linear motion there is an inherent problem of noise, particularly at times of high-speed rotation.

Furthermore, the inertial force produced when a drive source of a capacity that is not correspondent to the load of the moving body is employed is a cause of, for example, increased prevalence of the occurrence of chatter at times of starting, stopping, and inching, as well as premature wear of the component parts of the drive device and fallout of the workpiece. In addition, due to insufficient force at times of acceleration, there are times when the workpiece conveyance device is unable to comply with the speed required by the press machine whereupon, accordingly, a reduced production speed must be set.

With the foregoing problems in mind, it is an object of the present invention to provide a workpiece conveyance device for a press machine which consumes less energy, enables reduction in production costs and noise level by simplifying the work conveyance device, and reduces the output of the drive source in the feed direction.

Means for Solving the Problems

A workpiece conveyance device for a press machine of a first invention for achieving these objects comprises a pair of transfer bars provided in parallel to the feed direction, support members for moving the transfer bars freely in the feed direction while restricting the transfer bars in the lift direction, linear motors interposed between the support members and the transfer bars, for moving the transfer bars in the feed direction relative to the support members, lift devices for moving the support members in the lift direction, and workpiece holding jigs detachably mounted on the transfer bars, for holding the workpiece.

In addition, the workpiece conveyance device for a press machine of the first invention further comprises cross bars provided between the pair of transfer bars and spanning in the clamp direction orthogonal to the feed direction, the workpiece holding jigs being preferably arranged in the cross bars.

Furthermore, a workpiece conveyance device for a press machine of a second invention is configured to comprise a pair of transfer bars provided in parallel to the feed direction, support members for moving the transfer bars freely in the feed direction while restricting the transfer bars in the lift direction and the clamp direction, linear motors interposed between the support members and the transfer bars, for driving the transfer bars in the feed direction relative to the support members, lift devices for moving the support members in the lift direction, clamp devices for moving the support members in the clamp direction, and workpiece holding jigs detachably mounted on the transfer bars, for holding the workpiece.

Effects of the Invention

According to the first invention, the transfer bars are moved in the feed direction relative to the support members and the support members are rise/fall driven by a lift device by feed devices configured from linear motors in which the magnet side or coil side of a direct linear motor is laterally installed in the transfer bars and which are interposed between the support members and transfer bars. By isolating the feed devices and lift devices in this way, the load of a moving body with respect to the feed device can be reduced and the workpiece conveyance device is able to more easily comply with the high-speed rotation of the press machine. Accordingly, the output of the linear motor can be suppressed, energy reduction can be achieved, and the manufacturing costs can be suppressed.

In addition, because a linear motor drive is used a power converting mechanism for converting rotational motion to linear motion is unnecessary and, accordingly, a lowering of noise can be achieved particularly at times of high-speed rotation.

Furthermore, in the first invention, the provision in the transfer bars of cross bars that span in the direction orthogonal to the longitudinal direction thereof and the arrangement of workpiece holding jigs in the cross bars facilitating the holding of thin or thick workpieces in the appropriate position in the middle part thereof. Accordingly, deformation of the workpiece during conveyance is reduced and reliable conveyance of the workpiece is ensured and, in addition, the generation of defective products due to deformation of the workpiece occurring during conveyance can be suppressed.

According to the second invention which constitutes a 3-dimensional transfer feeder based on, in addition to the lift device of the first invention, the provision of a clamp device for moving the support members in the clamp direction, identical effects to those of the first invention are achieved.

DETAILED DESCRIPTION OF THE INVENTION

A first embodiment of the workpiece conveyance device pertaining to the present invention will be described hereinafter with reference to FIGS. 1 to 3.

Figure 1:
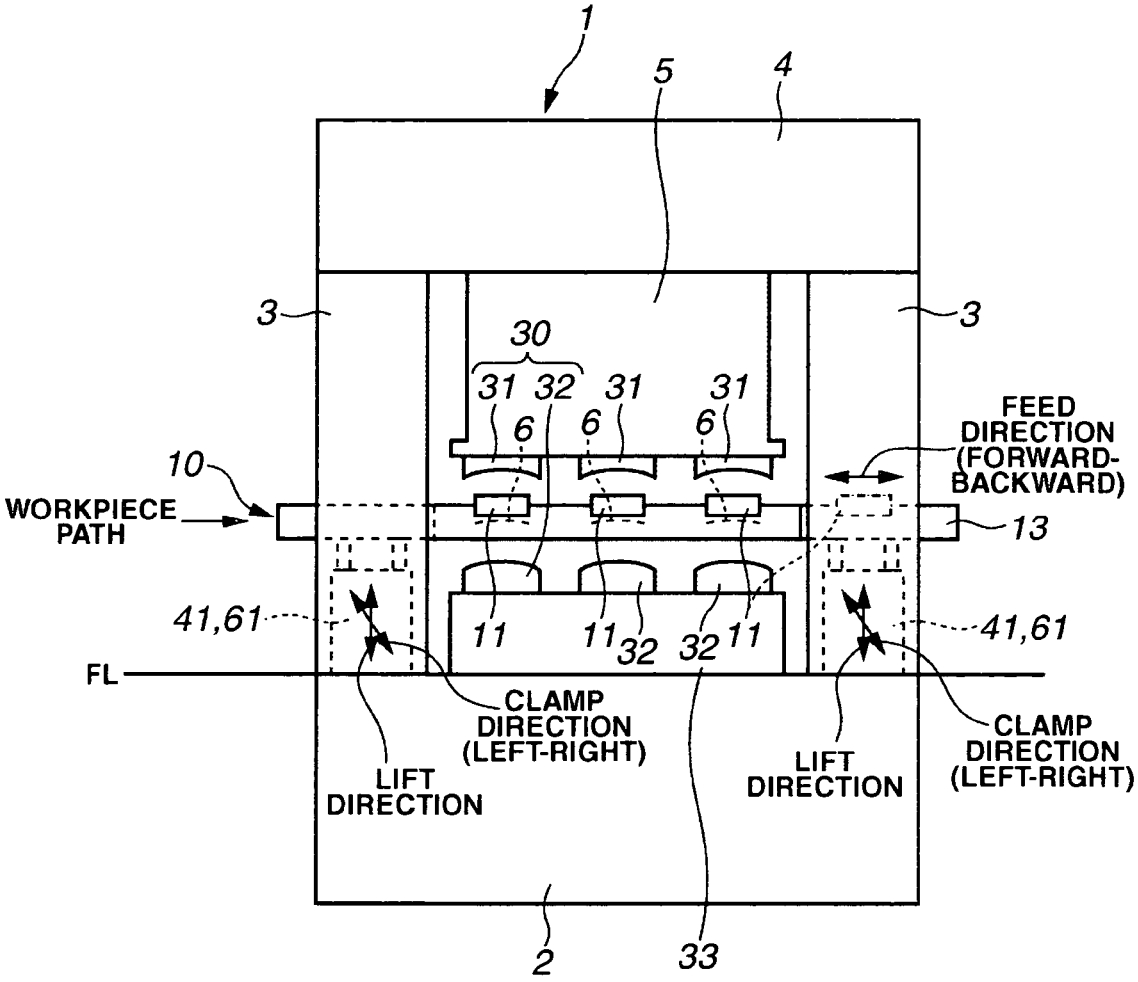
FIG. 1 is an overall block diagram of a press in which a first embodiment of the workpiece conveyance device is employed.
Figure 2:
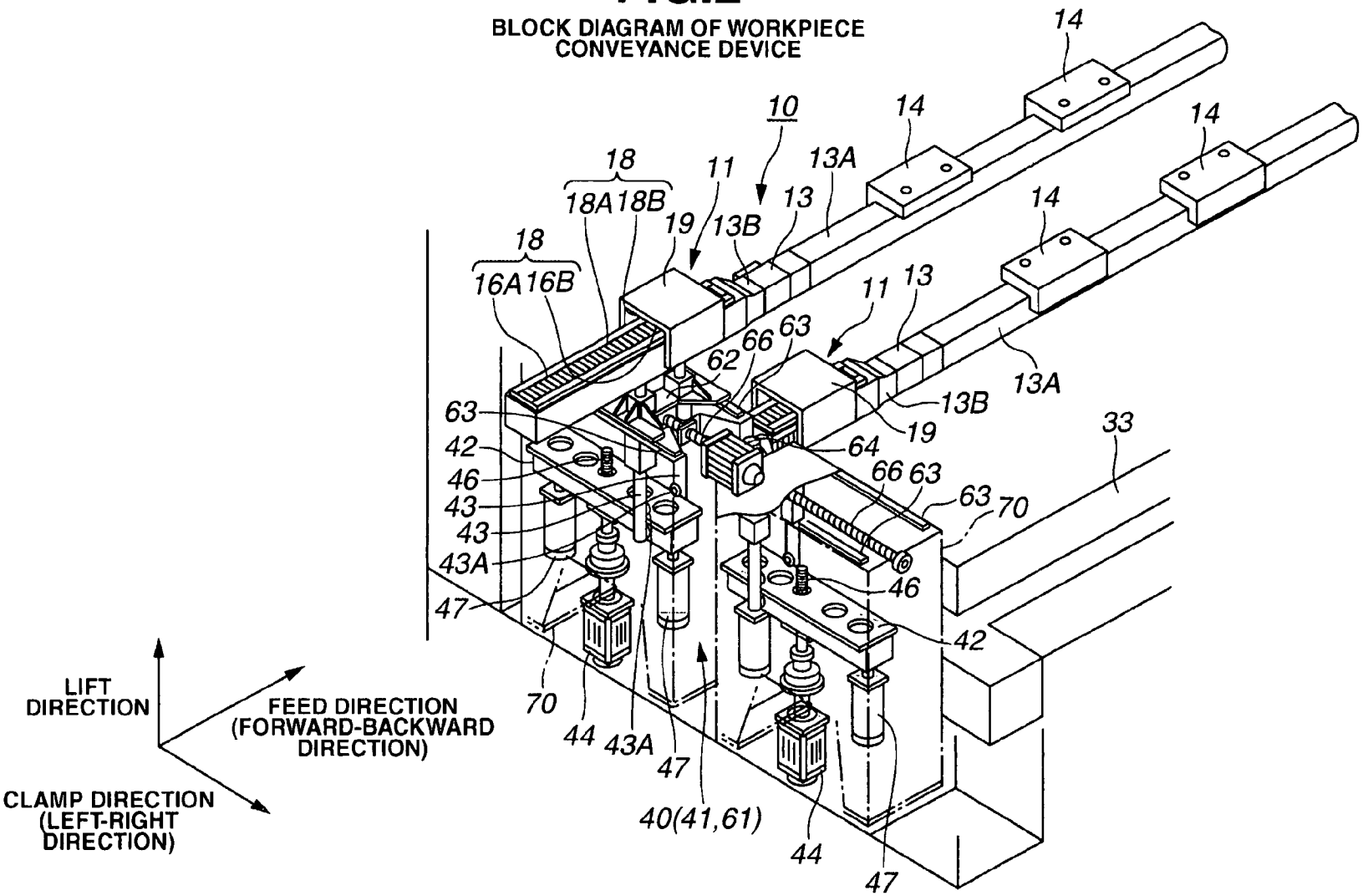
FIG. 2 is a block diagram of the first embodiment of the workpiece conveyance device.
Figure 3:
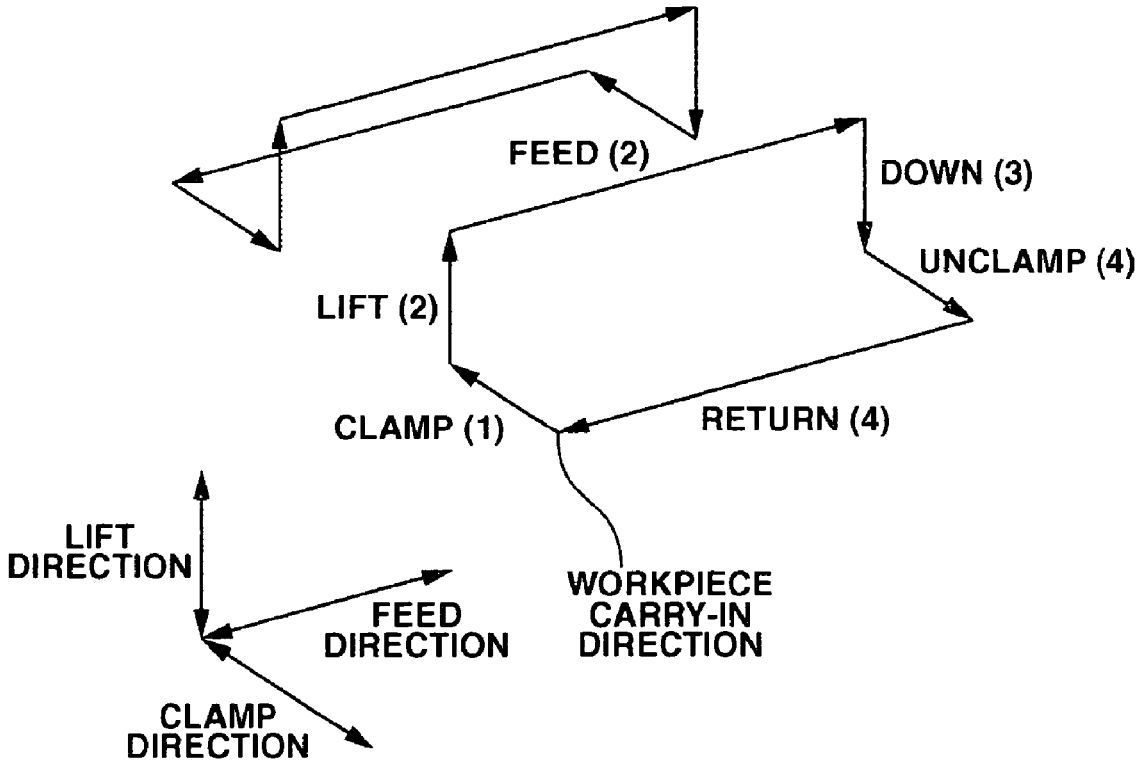
FIG. 3 is a diagram showing the motion of the first embodiment.

FIG. 1 is an overall block diagram of a transfer press in which the workpiece conveyance device of the present invention is employed, FIG. 2 shows the configuration pertaining to the workpiece conveyance device of the present invention, and FIG. 3 is a diagram showing the motion of the first embodiment.

First, the overall configuration of the transfer press serving as an embodiment of the present invention will be described with reference to FIG. 1.

The transfer press is configured from a press main body 1 comprising a bed 2, uprights 3, crown 4 and slide 5, and a mold 30, moving bolster 33 and workpiece conveyance device 10. In the following description the direction in which the workpiece is conveyed (left-right direction of FIG. 1) is referred to as the feed direction or the forward-backward direction, the up-down direction of FIG. 1 is referred to as to the lift direction or up-down direction, and the direction perpendicular to the feed direction in the horizontal plane (direction perpendicular to the plane of the paper surface of FIG. 1) is referred to as the clamp direction or left-right direction.

The bed 2 serving as a pedestal for the press machine is provided below a floor (FL), the columnar uprights 3 being provided upright in four corners in the upper surface thereof. In addition, the crown 4 in which a slide drive device not shown in the diagram is installed is supported by the uprights 3, and the slide 5 is suspended below the crown 4 to rise and fall freely. The crown 4, uprights 3 and head 2 are fastened by a tie rod not shown in the diagram.

Upper molds 31 correspondent to each of the processing steps for press molding are fitted to the lower surface of the slide 5. In addition, the moving bolster 33 is mounted on the bed 2, lower molds 32 forming pairs with the plurality of upper molds 31 being detachably fitted on the upper surface thereof. The workpiece is press molded between the upper molds 31 and lower molds 32.

The moving bolster 33 will be hereinafter described.

The moving bolster 33 is normally provided in two sets. That is to say, in addition to a first moving bolster 33 in a press machine on which the in-use or used lower molds 32 are fitted, a second moving bolster (not shown in the diagram) to which lower molds to be used in a subsequent step are fitted in advance is provided externally of the press machine. In addition, a part of the workpiece conveyance device 10 to which workpiece holding jigs not shown in the diagram correspondent to each of the lower molds 32 are fitted is mounted on these moving bolsters 33.

The moving bolsters 33 comprise a self-propelling drive device, respectively. In addition, a rail not shown in the diagram is laid in the clamp direction on the floor FL and bed 2. The moving bolsters 33 are able to be carried freely out of the press machine (or into the press machine from the exterior) by means of the drive device and rail passing in the clamp direction between the uprights 3, 3 provided upright in the feed direction in the upper surface of the bed 2. As a result, used lower molds 32 can be promptly switched to the next lower mold to be used.

The first embodiment of the workpiece conveying device 10 of the present invention will be hereinafter described in detail with reference to FIG. 2.

The workpiece conveying device 10 is configured from a pair (hereinafter this is to be referred to as the left/right pair) of transfer bars 13, 13 being opposed to each other in the clamp direction, a feed device 11 for moving the workpiece along the transfer bars 13 in the feed direction, and a lift/clamp device 40 for moving the transfer bars 13 in the lift direction and clamp direction.

The transfer bars 13 are configured from fixed bars 13B fixed to the workpiece conveyance device 10 and moving bars 13A that separate from the fixing bars 13B during mold switching and a carried out of the press machine with the moving bolsters 33.

A plurality of pairs of bases 14, 14 are assembled in the left/right moving bars 13A, 13A. While not shown in the drawing, workpiece holding jigs correspondent to the mold 30 are detachably fitted to the bases 14.

Feed devices 11 for moving the transfer bars 13 in the feed direction are provided in each of the left/right pairs of transfer bars 13, 13.

The feed devices 11 comprise support members 19 for supporting the fixed bars 13B of the transfer bars 13, linear guides 18 for movably guiding the transfer bars 13 in the feed direction relative to the support members 19, and linear motors 16 for driving the transfer bars 13 in the feed direction.

The transfer bars 13 are movably held in the feed direction by the linear guides 18 which are configured from a linear guide rail 18A laid in the feed direction along the outer surface of the transfer bar 13 and a linear guide holder 18B fixedly attached to the inner surface of the support members 19.

Linear motors 16 for driving the feed devices 11 comprise a linear motor magnet 16A laid in the feed direction along the outer surface of the transfer bar 13 and a linear motor coil 16B fixedly attached to the inner surface of the support members 19.

The linear coil 16B and the linear motor magnet 16A are provided in the transfer bar 13 side and the support member side respectively.

Because the present invention uses a linear motor 16 that has no rotational drive components and an overall fewer number of component parts as the drive source of the feed devices 11, the feed devices 11 are weight-lightened and compacted. A reduction is noise is also achieved. Furthermore, because the linear motor 16 is provided between the transfer bars 13 and support members 19 and only the transfer bars 13 are moved, the load of the moving body can be reduced and the linear motor 16 can be operated at small output. In addition, because of the reduced load of the moving body, the occurrence of chatter of the transfer bars 13 at times of starting, stopping and inching can be suppressed, an increase in speed and the positioning precision of the feed devices 11 as a whole can be achieved, and high-speed rotation of the press machine is possible. In addition, the maintenance of the device is made easier because of the fewer component parts.

Next, the lift/clamp devices 40 for moving the transfer bars 13 in the lift direction and clamp direction will be described.

The lift/clamp devices 40 are configured from lift devices 41 for moving the transfer bars 13 in the lift direction, and a clamp device 61 for moving the transfer bars 13 in the clamp direction. The lift/clamp devices 40, 40 are housed in lift/clamp boxes 70, 70. The lift/clamp boxes 70, 70 are arranged in the feed direction on the bed 2 below the support members 19 of the two end parts of the transfer bars 13, 13 and between the opposing uprights 3, 3 in the clamp direction.

The lift devices 41 from which the lower part of the lift/clamp devices 40 are configured comprises a lift drive motor 44 and a lift screw 46 rotated by the lift drive motor 44. A lift carrier 42 is screwed into the upper end part of the lift screw 46. The lower end part of lift bars 43, 43 opposing in the feed direction are movably affixed in the clamp direction to the lift carrier 42 by way of cam followers 43A, 43A. The upper end part of the lift bars 43, 43 are fixed by the support members 19.

The normal/reverse rotation of lift screw 46 by the lift drive motor 44 results in the rise-fall movement of the lift carrier 42 screwed with the lift screw 46. As a result, the transfer bars 13 are rise-fall moved in the lift direction by way of the lift bars 43, 43 and support members 18. Lift balancers 47, 47 for ensuring the smooth rise-fall movement thereof and for balancing the load between, for example, the transfer bars 13 and lift carrier 42 are mounted in the two end parts in the clamp direction of the lift carrier 42.

The clamp device 61 from which the upper part of the lift clamp device 40 is configured will be hereinafter described. The lift bars 43, 43 are inserted into a guide region of clamp carriers 62, 62. A clamp screw 66 rotated by a clamp drive motor 64 provided in the interior of the lift/clamp box 70 is screwed in the clamp carriers 62, 62. In addition, a left-right linear guide rail 63 is laid in the clamp direction on the upper surface of the clamp box 70. The clamp carrier 62 is movably mounted in the clamp direction on the left-right linear guide rail 63 by way of a left-right linear guide holder not shown in the diagram.

The normal/reverse rotation of clamp drive motor 64 results in the reciprocating movement of the clamp carriers 62 screwed with the clamp screws 66 in the clamp direction along the left-right linear guide rail.

Because the support members 19 are provided above the lift/clamp devices 40 in this way, the feed box 111 of a conventional press main body protrudingly provided from the front side (upstream side) or rear side (downstream side) face is unnecessary, and a simple cover only is sufficient. For this reason, the overall length of the press line can be shortened, and the area occupied by the press line as a whole can be reduced.

The operation of the first embodiment of the workpiece conveyance device will be hereinafter described with reference to FIG. 2 and FIG. 3 that shows the motion of the first embodiment.

(1) First, a workpiece 6 is carried in and mounted by a carry-in device not shown in the diagram to a workpiece pedestal not shown in the diagram of a workpiece carry-in position of the transfer bars 13 (front-end position of transfer bars 13, 13).

At this time, the transfer bars 13 in the down position (transfer bars 13, 13 lowered) are moved from the unclamp (transfer bars 13, 13 separate) position to the clamp (transfer bars 13, 13 together) position and the workpiece 6 on the workpiece pedestal is fixed by the workpiece holding jig 15 affixed to the base 14.

(2) Next, the transfer bars 13, in a state in which the workpiece 6 is fixed by the workpiece holding jig 15, are lifted (transfer bars 13, 13 raised) by the lift devices 41 by way of the support members 19 and, furthermore, are fed (advance conveyed) by the feed devices 11 control-driven by the linear motors 16. As a result, the workpiece 6 fixed by the workpiece holding jig 15 is fed (advance conveyed) to the position of the first processing step (in FIG. 1, the processing step at the left end of the slide 5) for press mold processing.

(3) Thereafter, by the down movement of the transfer bars 13 by the lift devices 41 subsequent to the workpiece 6 reaching the position of the first processing step for press mold processing, the workpiece 6 is set on the lower mold 32 for the first processing step for press mold processing arranged on the upper surface of the moving bolster 33.

(4) Following the completion of the setting of the workpiece 6 on the lower mold 32, the transfer bars 13 are unclamped by the clamp device 61 resulting in the withdrawal of the workpiece holding jig 15 from the workpiece 6. After the transfer bars 13 have been unclamped and have reached the clamp retreat end, the transfer bars 13 are returned (retreat conveyed) to the initial carry-in position by the feed devices 11.

(5) On the other hand, after the workpiece holding means 15 as described above have been unclamped (transfer bars 13, 13 retreated) and has retreated to a non-interfering region with the mold 30, a predetermined first processing step is performed for press mold processing in which the slide 5 is lowered and the upper molds 31 affixed to the lower surface thereof are lowered so that the workpiece 6 is enclosed and pressurized between this and the lower molds 32.

(6) Thereafter, the conveyance of the workpiece 6 to the next processing step and the mold processing thereof are similarly implemented by conveyance of the workpiece by the above-described workpiece conveyance device 10 from the carry in position to the position for first processing step for press mold processing (described by (1) to (4)) and the mold processing of the workpiece 6 of the first processing step (described by (5)) are carried out in the same way. That is to say, the conveyance of the workpiece by the workpiece conveyance device 10 from the position for the first processing step for press mold processing to the position for the second processing step and the mold processing of the workpiece 6 in the second processing step are carried out in the same way. In addition, the conveyance of the workpiece by the workpiece conveyance device 10 from the position for the second processing step for press mold processing to the position for the third processing step and the mold processing of the workpiece 6 of the third processing step are carried out in the same way.

(7) Once the mold processing of the third processing step of the workpiece 6 is completed at the position for the third processing step, the workpiece 6 is subsequently conveyed by the workpiece conveyance device 10 from the position of the third processing step for press mold processing to the workpiece pedestal of the workpiece carry-out position of the transfer bars 13 (rear end position of transfer bars 13, 13).

(8) The molded workpiece 6 carried to the workpiece pedestal of the workpiece carry out position is carried outside the press mold by a product carry out device not shown in the diagram.

In the workpiece conveyance device of the first embodiment outlined above a 3-dimensional operation for the reciprocating feed/return movement in the feed direction, the reciprocating rise/fall movement in the top-bottom direction and reciprocating clamp/unclamp movement in the clamp direction orthogonal in the horizontal orthogonal direction to the feed direction of the transfer bars 13 is performed.

Figure 4:
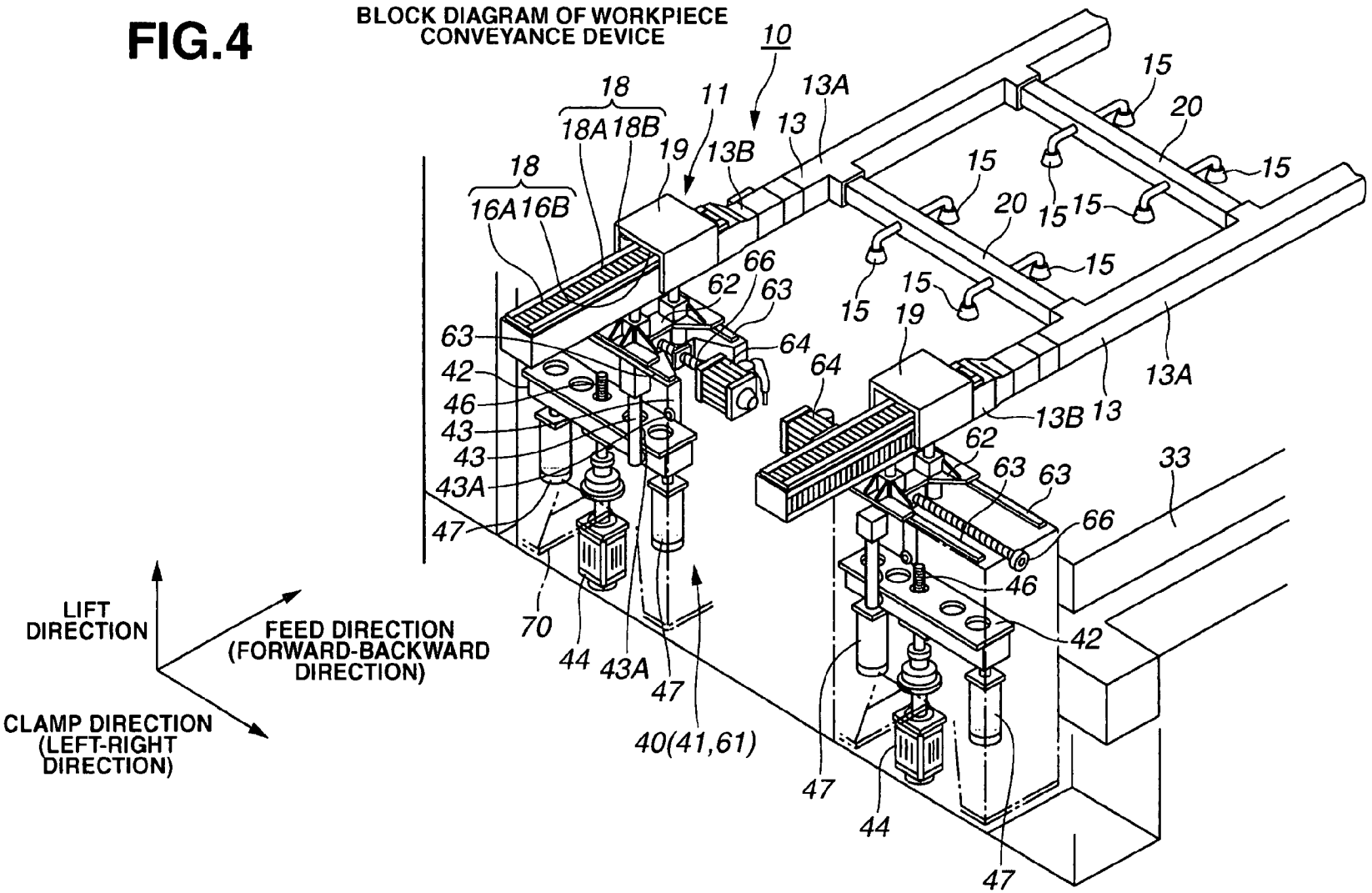
FIG. 4 is a block diagram of a second embodiment of the workpiece conveyance device.

A second embodiment of the present invention will be described with reference to FIG. 4.

The description of the structural sections thereof identical to those of the first embodiment has been omitted.

In the second embodiment the transfer bars 13, 13 are fixed in the clamp direction as a result of a stopping of the drive of the clamping devices 61 of the first embodiment. By virtue of this, cross bars 20 span between the transfer bars 13, 13 maintaining a constant clearance therebetween. Workpiece holding jigs 15 arranged in the cross bars 20 in the lower part thereof hold the workpiece 6 by means of vacuum caps utilizing a negative pressure.

Figure 5:
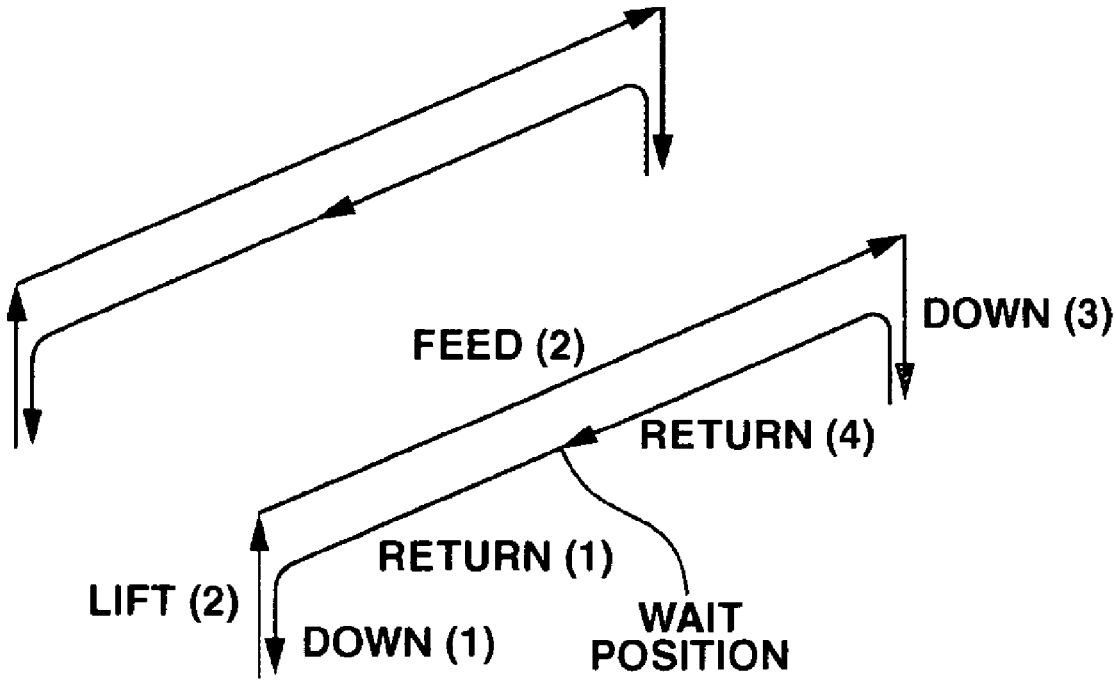
FIG. 5 is a diagram showing the motion of the second embodiment.

Next, the operation of the workpiece conveyance device of the second embodiment will be described with reference to FIG. 4 and FIG. 5 that shows the motion of the second embodiment.

(1) First, a workpiece 6 is carried in and mounted by a carry-in device (not shown in the diagram) to a workpiece pedestal not shown in the diagram of a workpiece carry-in position of the transfer bars 13 (front-end position of the bars).

Following this, the cross bars 20 in the wait position are returned with the transfer bars 13. After the cross bars 20 are returned to the workpiece pedestal they are moved downward whereupon the workpiece 6 is adsorbed onto the workpiece pedestal by means of the vacuum caps.

(2) Next, in a state in which the workpiece 6 has been adsorbed by the vacuum caps, the transfer bars 13 are lifted by the lift devices 41 by way of the support members 19 and then further fed (advance conveyed) by the feed devices 11 control-driven by the linear motors 16. As a result, the workpiece 6 adsorbed by the workpiece holding jig 15 is fed (advance conveyed) to the position for the first processing step (processing step at the left end of the slide 5 of FIG. 1) of the press mold processing.

(3) Thereafter, by the down movement of the transfer bars 13 by the lift devices 41 subsequent to the workpiece 6 reaching the position of the first processing step for press mold processing, the workpiece 6 is positioned on the lower mold 32 for the first processing step for the press mold processing arranged on the upper surface of the moving bolster 33 and the suction force of the vacuum caps is released. As a result, the workpiece 6 is set on the lower mold 32.

(4) After completion of the setting of the workpiece 6 on the lower mold 32 the transfer bars 13 are lifted. They are subsequently returned to the initial wait position.

(5) On the other hand, after the workpiece holding jigs 15 as described above have been set on the lower mold 32 and the cross bars retreated to a non-interfering region with the mold 30, a predetermined first processing step for press mold processing in which the slide 5 is lowered and the upper molds 31 affixed to the lower surface thereof are lowered so that the workpiece 6 is enclosed and pressurized between this and the lower molds 32 is performed.

(6) Thereafter, the conveyance of the workpiece 6 to the next processing step and the mold processing thereof are similarly implemented by conveyance of the workpiece by the above-described workpiece conveyance device 10 from the carry in position to the position for first processing step for press mold processing (described by (1) to (4)) and the mold processing of the workpiece 6 of the first processing step (described by (5)) are carried out in the same way. That is to say, the conveyance of the workpiece by the workpiece conveyance device 10 from the position for the first processing step for press mold processing to the position for the second processing step and the mold processing of the workpiece 6 in the second processing step are carried out in the same way. In addition, the conveyance of the workpiece by the workpiece conveyance device 10 from the position for the second processing step for press mold processing to the position for the third processing step and the mold processing of the workpiece 6 of the third processing step are carried out in the same way.

(7) Once the mold processing of the third processing step of the workpiece 6 is completed at the position for the third processing step, the workpiece 6 is subsequently conveyed by the workpiece conveyance device 10 from the position of the third processing step for press mold processing to the workpiece pedestal of the workpiece carry-out position of the transfer bars 13 (rear end position of bars).

(8) The molded workpiece 6 carried to the workpiece pedestal of the workpiece carry out position is carried outside the press mold by a product carry out device not shown in the diagram.

In the workpiece conveyance device 10 of the second embodiment outlined above a 2-dimensional operation is performed for the reciprocating feed/return movement in the feed direction and the reciprocating rise/fall movement in the top-bottom direction of these transfer bars 13.

Figure 6:
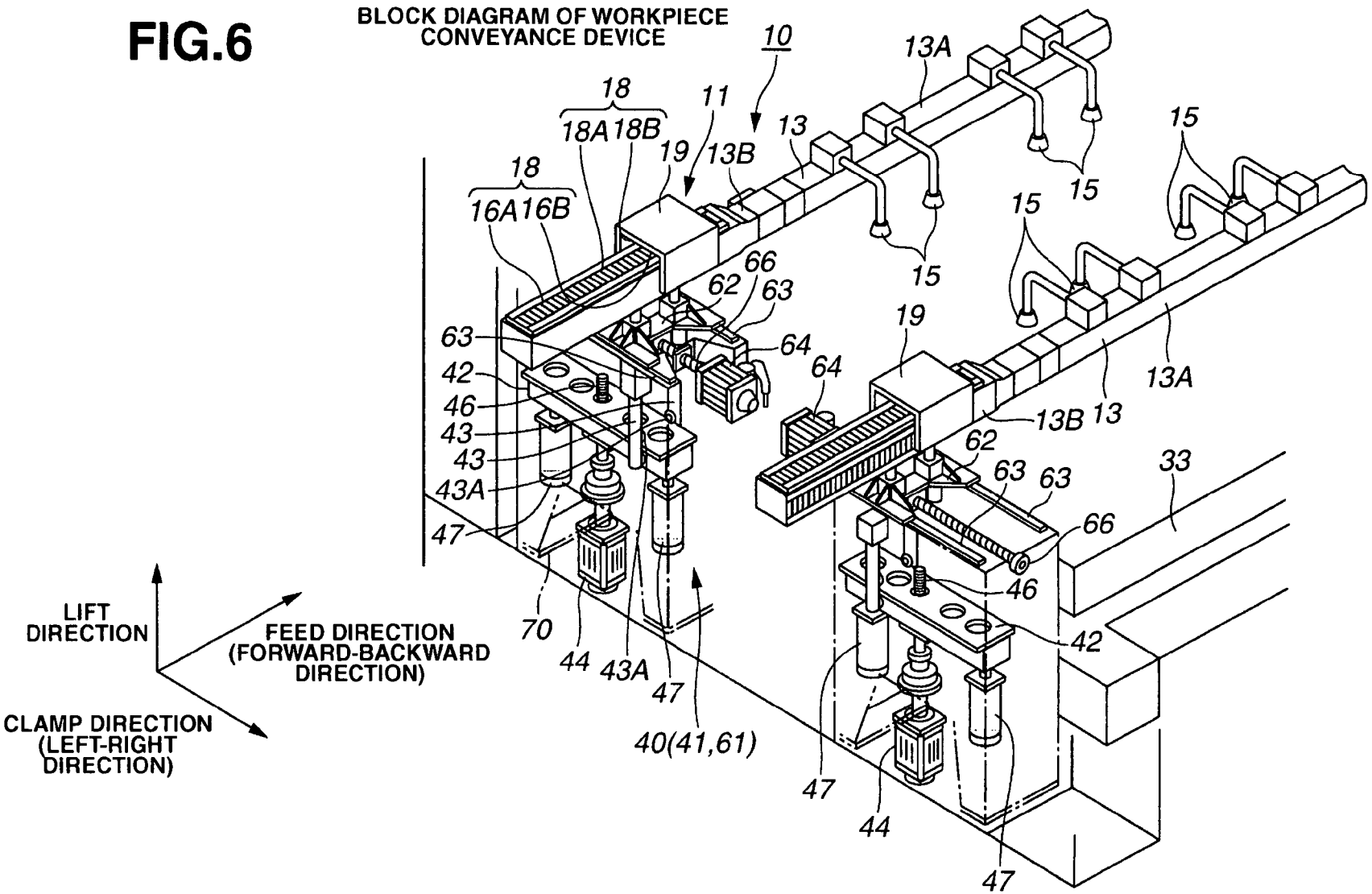
FIG. 6 is a block diagram pertaining to another mode of the second embodiment of the workpiece conveyance device.
Figure 7:
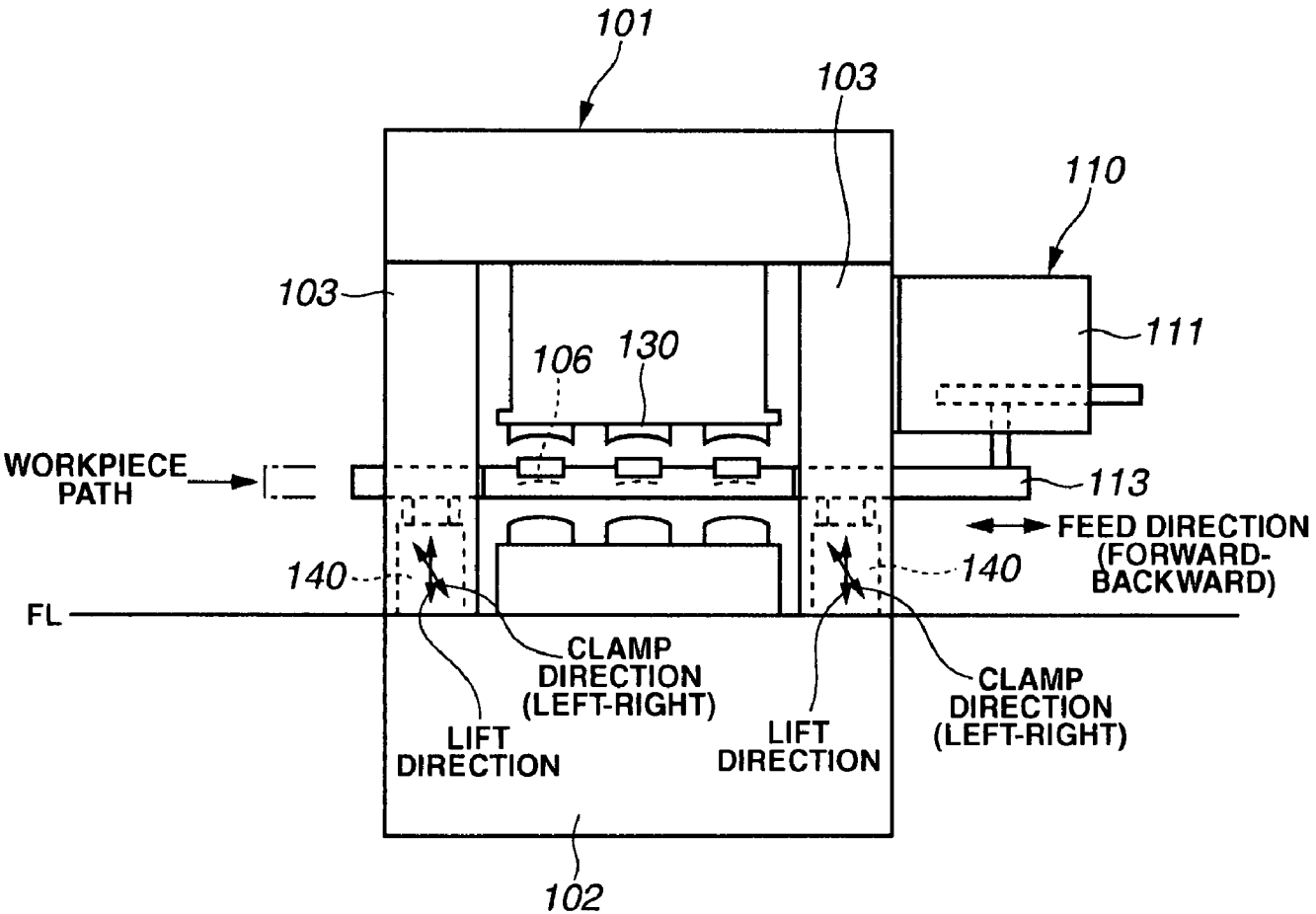
FIG. 7 is an overall block diagram of a press in which a conventional 3-dimensional transfer feeder is employed.

While in the second embodiment the vacuum caps that serve as the workpiece holding jigs 15 are arranged on the cross bars 20, as shown in FIG. 6, the vacuum caps may be arranged on the transfer bars 13.

In addition, in the second embodiment the drive of the clamp device 16 as of the first embodiment is stopped and the transfer bar is 2-dimensionally moved. If the use of the workpiece conveyance device 10 is restricted to vacuum conveyance alone in which 2-dimensional movement is employed, the clamp device is unnecessary at this time. For this reason, a configuration based on the use of a lift device alone from the beginning and that does not comprise a clamp device may be adopted.

In addition, while for switching of the molds in the second embodiment the transfer bars 13 are separated into a moving bar 13A and a fixed bar 13B, the moving bar 13A being set on the moving bolster 33 and conveyed to the exterior of the press, the cross bars 20 may be separated from the transfer bars 13 and the separated transfer cross bars 20 set on the moving bolster 33 and conveyed to the exterior of the press.

In this case there is no need for the transfer bars 13 to be separated.

An example in which the workpiece conveyance device 10 of the present invention of the embodiments described above has application in a twin-column press comprising two uprights 3, 3 in the feed direction will be described. However, there is no restriction to this configuration and, for example, application thereof in a three-column press comprising three uprights 3 in the feed direction or in a press machine comprising a greater number of uprights is also possible.

In addition, the lift drive motor 44 and clamp drive motor 64 of the embodiments described above may be configured as linear motors such as the linear motors 16 serving as the drive source of the feed devices 11.

In addition, while in the embodiments described above the lift/clamp box 70 is arranged on the bed 2 below the transfer bars 13, it may be arranged between the uprights 3, 3 above the transfer bars 13. In this case the transfer bars 13 are of a shape that suspends downward by way of the support members 19.

Furthermore, in the embodiments described above, as a result of the provision of the lift/clamp box 70 in the front and rear end parts of the transfer bars 13, two support members 19 positioned above the lift/clamp box 70 may be provided for each individual transfer bar 13. However, the number of support members 16 with respect to each single transfer bar 13 may be 3 or more.

In addition, provided the output of the servomotor is further increased, there is no need for the provision of a linear motor for any support members. For example, a linear motor and linear guide may be provided in the front side (upstream side) of the support member 16 only, and only the linear guide may be provided in the rear side (downstream side) support member 16.

The effects of the invention of the subject application can also be achieved in retrofitting.

The retrofitting of a press based on the replacement of a cam-driven workpiece conveyance device of an existing press machine with servocontrol-driven device to improve functions including increased speed and capacity to deal with various types of workpiece has become a frequently implemented trend in transfer presses in recent years. When retrofitting is carried out the conventional case in which a servomotor is used as the feed direction drive source the feed box which is the main part of the feed device and which is protrudingly arranged in the carry-out side (or workpiece carry-in side) face of the press main body remains and, as a consequence, the feed box is replaced. Because of the large size and weight of the feed box and, moreover, because it is protrudingly provided in the side face of the press main body, it takes a significant number of construction days to carry out the construction necessary for replacement of the feed box which includes welding of feed box brackets to the press main body.

Because of the long period of stoppage to the operation of the production manufacturing line necessitated by this retrofitting it interferes with the production principles of the user.

The feed carrier for supporting the transfer bars of the patent literature 1 is also large and heavy and is accompanied by the installation of a large feed box.

The support members of the present invention are provided above (or below) the lift/clamp device only and, accordingly, either the feed box is unnecessary or a simple cover advantageous in terms of safety or as a scrap countermeasure is sufficient. For this reason, the construction period required for retrofitting construction can be shortened and the interference to the production principles of the user can be minimized.

The invention claimed is:

1. A workpiece conveyance device for a press machine, the workpiece conveyance device comprising:

a first transfer bar extending in a feed direction;

a second transfer bar arranged in parallel to the first transfer bar;

a first support member supporting the first transfer bar such that the first transfer bar is movable in the feed direction, wherein the first support member is movable in a lift direction;

a second support member supporting the second transfer bar such that the second transfer bar is movable in the feed direction, wherein the second support member is movable in the lift direction;

a first linear motor interposed between the first support member and the first transfer bar for driving the first transfer bar in the feed direction relative to the first support member;

a second linear motor interposed between the second support member and the second transfer bar for driving the second transfer bar in the feed direction relative to the second support member;

lift devices for driving the first support member and the second support member in the lift direction; and workpiece holding jigs detachably mounted to the first transfer bar and the second transfer bar for holding a workpiece such that the workpiece is fed in the feed direction.

2. The workpiece conveyance device of claim 1, further comprising:

cross bars provided between the first transfer bar and the second transfer bar, the cross bars extending in a clamp direction perpendicular to the feed direction, wherein the workpiece holding jigs are arranged on the cross bars.

3. The workpiece conveyance device of claim 2, wherein the feed direction is perpendicular to the lift direction and the clamp direction, and wherein the lift direction is perpendicular to the clamp direction.

4. The workpiece conveyance device of claim 1, wherein the feed direction is perpendicular to the lift direction.

5. The workpiece conveyance device of claim 1, wherein a longitudinal axis of each of the first transfer bar and the second transfer bar is parallel to the feed direction, and wherein the feed direction is perpendicular to the lift direction.

6. A workpiece conveyance device for a press machine, the workpiece conveyance device comprising:

a first transfer bar extending in a feed direction;

a second transfer bar arranged in parallel to the first transfer bar;

a first support member supporting the first transfer bar such that the first transfer bar is movable in the feed direction, wherein the first support member is movable in a lift direction and a clamp direction;

a second support member supporting the second transfer bar such that the second transfer bar is movable in the feed direction, wherein the second support member is movable in the lift direction and the clamp direction;

a first linear motor interposed between the first support member and the first transfer bar for driving the first transfer bar in the feed direction relative to the first support member;

a second linear motor interposed between the second support member and the second transfer bar for driving the second transfer bar in the feed direction relative to the second support member;

lift devices for driving the first support member and the second support member in the lift direction;

clamp devices for driving the first support member and the second support member in the clamp direction; and workpiece holding jigs detachably mounted to the first transfer bar and the second transfer bar for holding a workpiece such that the workpiece is fed in the feed direction.

7. The workpiece conveyance device of claim 6, wherein the feed direction is perpendicular to the lift direction and the clamp direction, and wherein the lift direction is perpendicular to the clamp direction.

8. The workpiece conveyance device of claim 6, wherein a longitudinal axis of each of the first transfer bar and the second transfer bar is parallel to the feed direction, and wherein the feed direction is perpendicular to the lift direction and the clamp direction, and the lift direction is perpendicular to the clamp direction.

9. A workpiece conveyance device for a press machine, the workpiece conveyance device comprising:

a first transfer bar extending in a feed direction;

a second transfer bar arranged in parallel to the first transfer bar;

a first support member supporting the first transfer bar such that the first transfer bar is movable in the feed direction relative to the first support member;

a second support member supporting the second transfer bar such that the second transfer bar is movable in the feed direction relative to the second support member;

a first linear motor interposed between the first support member and the first transfer bar for driving the first transfer bar in the feed direction relative to the first support member;

a second linear motor interposed between the second support member and the second transfer bar for driving the second transfer bar in the feed direction relative to the second support member;

lift devices for driving the first support member and the second support member in the lift direction;

clamp devices for driving the first support member and the second support member in the clamp direction; and workpiece holding jigs detachably mounted to the first transfer bar and the second transfer bar for holding a workpiece such that the workpiece is fed in the feed direction, wherein the first transfer bar is coupled to the first support member such that the first transfer bar moves with the first support member in the lift direction and the clamp direction, wherein the second transfer bar is coupled to the second support member such that the second transfer bar moves with the second support member in the lift direction and the clamp direction, and wherein a longitudinal axis of each of the first transfer bar and the second transfer bar is parallel to the feed direction.

10. The workpiece conveyance device of claim 9, wherein the feed direction is perpendicular to the lift direction and the clamp direction, and wherein the lift direction is perpendicular to the clamp direction.

* * * * *